United States Patent [19]

Hochfelsen

[11] 4,132,295

[45] Jan. 2, 1979

[54] ARTICLE-CARRYING CASE AND ATTACHING AND ARTICLE-SUPPORTING HINGE UNIT THEREFOR

[75] Inventor: Jerrold J. Hochfelsen, North Miami Beach, Fla.

[73] Assignee: Cresswell E. Stedman, Jr., Miami, Fla.; a part interest

[21] Appl. No.: 738,684

[22] Filed: Nov. 4, 1976

[51] Int. Cl.[2] ..... A45C 13/00; E05D 3/06

[52] U.S. Cl. ..... 190/60; 248/282; 312/24; 312/27; 312/30; 325/310; 16/135; 16/163

[58] Field of Search ..... 190/60, 42, 29, 31, 190/32; 220/23.86; 248/282, 284; 312/24, 27, 30, 351; 325/310, 353, 350, 361; 16/135, 173, 183, 156, 163

[56] References Cited

U.S. PATENT DOCUMENTS

| | | | |
|---|---|---|---|
| 623,189 | 4/1899 | Smith | 248/282 |
| 1,693,526 | 11/1928 | Owens | 16/163 |
| 2,031,526 | 2/1936 | Demuth | 16/163 |
| 2,486,536 | 11/1949 | Olson | 190/42 |
| 2,802,906 | 8/1957 | Goldenberg et al. | 248/284 |
| 2,850,760 | 9/1958 | Vanderwalker | 16/163 |
| 3,070,338 | 12/1962 | Cohn | 248/284 |
| 3,178,034 | 4/1965 | Cohn | 248/282 |
| 3,969,846 | 7/1976 | Scott | 16/135 |

FOREIGN PATENT DOCUMENTS

| | | | |
|---|---|---|---|
| 557784 | 12/1943 | United Kingdom | 16/163 |

*Primary Examiner*—William Price
*Assistant Examiner*—Joseph M. Moy
*Attorney, Agent, or Firm*—Charles B. Cannon

[57] ABSTRACT

As article-carrying case and an article-supporting and hinge unit therefor in which the article-carrying case includes a body and a closure member or top horizontally connected thereto. An article or apparatus, such as a CB (Citizen's Band) radio unit, recording device, dictating unit, or the like, is mounted on and is attached to a supporting base plate of the article-supporting and hinge construction which includes an attaching hinge section which is attached to the inner surface of one side wall of the body of the article-carrying case. The hinge unit includes an article-supporting section and an intermediate hinge section between the attaching hinge section and the article-supporting section which enables the article-supporting section and an article mounted thereon to be enclosed within the body of the article-carrying case when not in use or to be withdrawn from the body of the article-carrying case unit and rested on the top of the closed cover of the article-carrying case when in use.

23 Claims, 16 Drawing Figures

ARTICLE-CARRYING CASE AND ATTACHING AND ARTICLE-SUPPORTING HINGE UNIT THEREFOR

OBJECTS

An object of the invention is to provide a novel combination of an article-carrying case, such as an attache' case, suit case, cabinet, vanity, or the like, and a novel attaching and article-supporting hinge unit including an attaching hinge section which is rigidly attached to the inner surface of one wall of the article-carrying case and another article-supporting section which is adapted to support an article or apparatus such as a CB (Citizen's Band) radio apparatus, recording device, dictating unit, or the like, in such a manner that when the supported article or apparatus is not is use it may be carried and concealed within the body of the article-carrying case but when it is desired to use the supported article or apparatus, it may readily be withdrawn on the said hinge unit from the body of the article-carrying case by opening the closure member or cover therefor, the closure member or cover therefor closed, and the supported article or apparatus rested on the top of the closure member or cover for use and so that the control dials on the apparatus may be exposed for use.

A further object of the invention is to provide a novel portable combination of an article-carrying case and a hinge unit therefor which is adapted to carry an article, such as a CB (Citizen's Band) radio apparatus, recording device, dictating unit, or the like, in the article-carrying case when not in use and is adapted to position the article or apparatus on the top surface of the cover of the article-carrying case for use in an automotive vehicle, boat or the like, in which is may be used without the necessity for making the article or apparatus a permanent installation in the automotive vehicle, boat or the like.

An additional object of the invention is to provide a novel portable CB (Citizen's Band) radio apparatus which may be carried into and out of an automotive vehicle, boat, or the like, without making it a permanent installation in the automotive vehicle, boat, or the like, thereby eliminating the likelihood of theft of the radio apparatus from the automotive vehicle, boat, or the like.

A further object of the invention is to provide a novel article-supporting and attaching hinge unit for enabling an article or apparatus, such as a CB (Citizen's Band) radio apparatus, recording device, dictating unit, or the like, to be permanently attached to and carried within the body of an article-carrying case, such as an attache' case, suitcase, or the like, and to be carried from the user's home or office to a place where it may be used, such as an automotive vehicle, boat, or elsewhere, and be protected while it is being transported, while enabling the article or apparatus to be withdrawn from the body of the article-carrying case and positioned on the upper surface of the closure member or cover when it is desired to use the thus supported article or apparatus, and in such a manner that the thus supported article or apparatus will not fall off the supporting cover or top of the article-carrying case when in use.

Another object of the invention is to provide a novel combination of an article-carrying case, such as an attache' case, brief case, or the like, which includes a body having upright peripheral walls and a closure member or cover hingedly connected to one of the upright, peripheral walls of the body of the article-carrying case, and a novel article-supporting and attaching hinge unit including a first and attaching hinge section which is adapted to be attached to one of the upright peripheral walls of the body of the article-carrying case on the inner side thereof, an article-supporting hinge section providing a supporting base for supporting the article or apparatus to be carried, and an intermediate hinge section interconnecting the said first and attaching hinge section and the said article-supporting hinge section.

An additional object of the invention is to provide a novel article-attaching and supporting hinge unit which may be used not only in article-carrying cases but also in connection with other things such as pull-out platforms, hideaway storage units, vanities, chests and other articles of furniture and also as a built-in unit for airplanes, boats, automotive vehicles, mobile homes, and the like.

Other objects will appear hereinafter.

DESCRIPTION OF FIGURES IN THE DRAWINGS

FIG. 1 is a perspective view of a typical and preferred embodiment of the new article-carrying case and article-supporting and hinge unit therefor showing the cover of the article-carrying case in closed position and showing the hinge unit and the apparatus supported thereby outfolded from the body of the article-carrying case and resting upon the top or cover of the article-carrying case in position of use;

FIG. 14 is a fragmentary elevational view of the modified form of the attaching and article-supporting hinge unit showing in FIG. 13 and the apparatus attached thereto infolded onto the body of an article-carrying case or the like;

Figure 13:
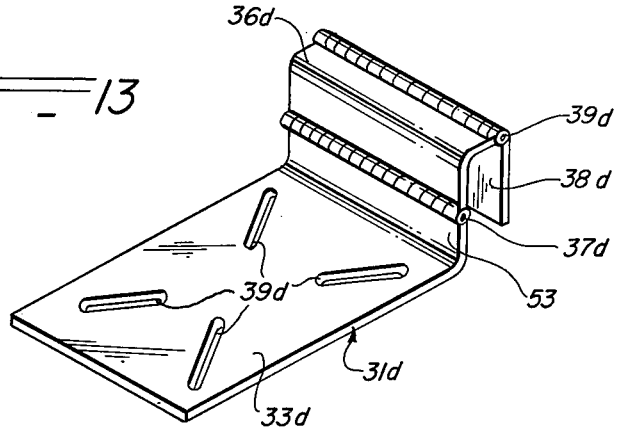
FIG. 13 is a perspective view of another modification of the new attaching and article-supporting hinge unit.
Figure 14:
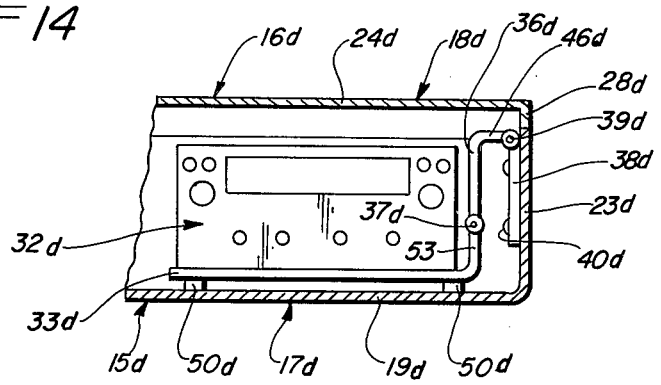
Figure 15:
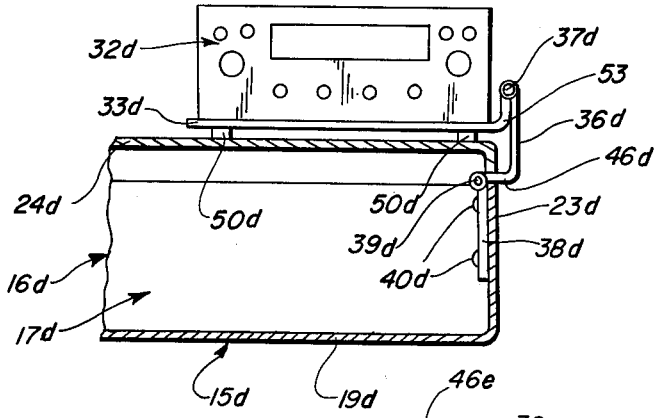
Figure 16:
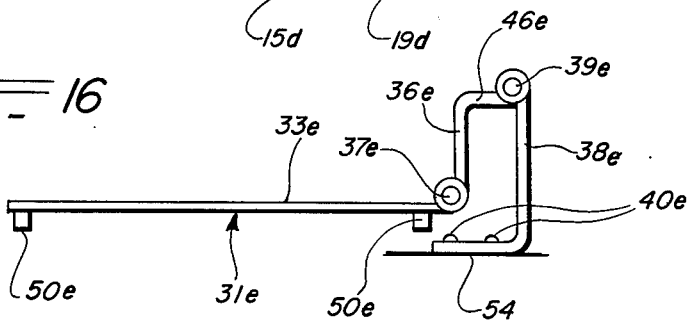

FIG. 15 is a fragmentary elevational view of the form of the invention illustrated in FIGS. 13 and 14 but showing the attaching and article-supporting hinge and the apparatus attached thereto outfolded from the body of the article-carrying case and with the apparatus resting upon the cover of the article-carrying case in position of use; and FIG. 16 is an elevational view illustrating another modification of the new attaching and article-supporting hinge unit.

DETAILED DESCRIPTION OF THE CONSTRUCTION OF THE NEW ARTICLE-CARRYING CASE AND ARTICLE-SUPPORTING AND ATTACHING HINGE UNIT ILLUSTRATED IN FIGS. 1 TO 9, INCLUSIVE, OF THE DRAWINGS

A typical and preferred embodiment of the invention is illustrated in FIGS. 1 to 9, inclusive, of the drawings, wherein it is generally indicated at 15, and comprises an article-carrying case, generally indicated at 16, including a body 17, and a closure member or cover 18 therefor.

The body 17 of the article-carrying case 16 includes a bottom wall 19, a plurality of upright peripheral walls including parallel front and rear walls 20 and 21, respectively, and parallel left and right side walls 22 and 23, respectively. The closure member or cover 18 includes a top wall 24, parallel front and rear walls 25 and 26, respectively, and parallel side walls 27 and 28, respectively. The article-carrying case 16 includes latching devices, as 29, for detachably latching the closure member or cover 18 to the body 17 of the carrying case 16, and hinge means, as 30, for hingedly connecting the rear wall 26 of the closure member or cover 18 to one of the upright walls, namely, the rear wall 21, of the body 17 of the article-carrying case 16.

Figure 1:
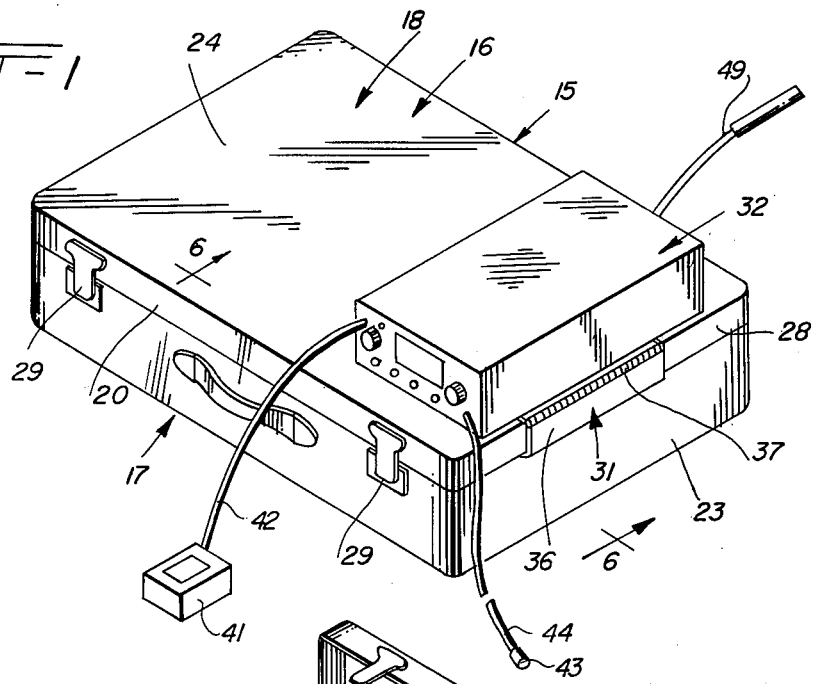
Figure 2:
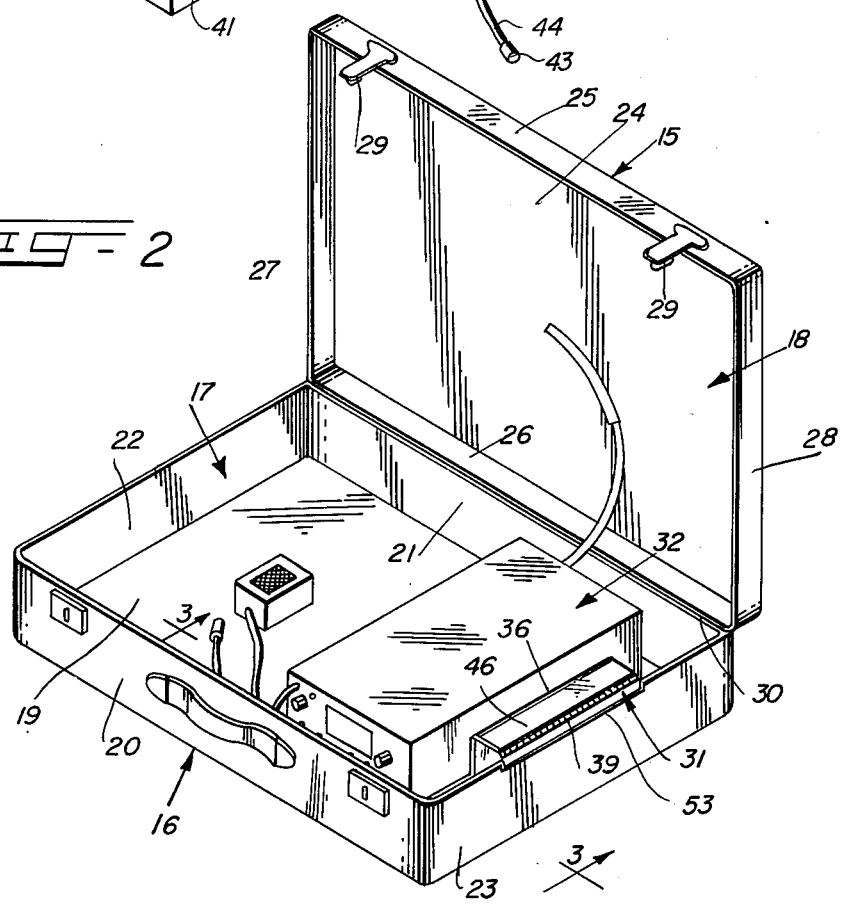
FIG. 2 is a perspective view of the new article-carrying case and article-supporting and hinge unit therefor as illustrated in FIG. 1, showing the cover of the article-carrying case in open position and showing the article-supporting and hinge unit and the article or apparatus supported thereby in infolded position in the body of the article-carrying case.
Figure 3:
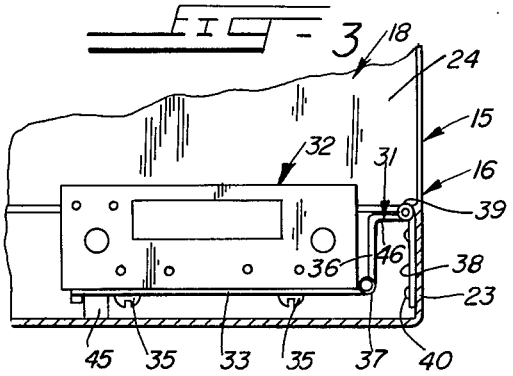
FIG. 3 is a fragmentary view, partly in section and partly in elevation, on line 3—3 in FIG. 2.
Figure 6:
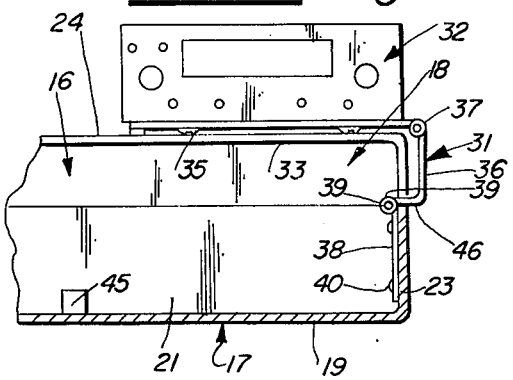
FIG. 6 is a view on line 6—6 in FIG. 1, partly in section and partly in elevation, showing the cover of the article-carrying case in closed position and showing the supported article or apparatus resting on the top of the cover in position of use.

The new article-carrying case and article-supporting and attaching hinge unit 15 includes a novel article-supporting and attaching unit 31 for supporting and hingedly mounting an article or apparatus, such as a CB (Citizen's Band) radio unit 32, of conventional design, or a recording or dictating unit, or the like, within the body 17 of the article-carrying case 16, when not in use, as in FIGS. 2 and 3, or outwardly thereof and supported on the top wall 24 of the cover or closure member 18, when in use, as in FIGS. 1 and 6.

The article-supporting and attaching unit 31 may be made of any suitable metal, such as steel, aluminum, or the like, or of molded plastic resinous material, and includes a first and generally rectangular attaching hinge section 38 and a second generally rectangular-shaped article-supporting hinge section 33 which provides an article-supporting base in which a series, as four, of mounting slots 34 may be provided and arranged at suitable spaced intervals thereon (FIG. 7); the supported article or apparatus 32 being mounted on and attached to the supporting base plate 33 by and suitable fastening means, such as screws 35, which are projected through the slots 34 into the body of the supported article or apparatus 32.

The supporting base plate 33 may also be provided with resilient rubber or plastic resinous material, or the like, bumper elements 50 for yieldably supporting the supporting base plate 33 and the article or apparatus 32 mounted thereon in position of use on the top wall 24 of the closure member 18 when in use, as in FIGS. 1 and 6.

The new article-supporting and attaching unit also includes a third intermediate and generally L-shaped hinge section 36 which is hingedly connected at one end, as at 37, to the article-supporting hinge section or base plate 33, and includes a laterally extending arm 46 which is hingedly connected, as at 39, to the first and attaching hinge section 38.

In the practice of the form of the invention illustrated in FIGS. 1 to 9, inclusive, the attaching hinge section 38 is attached, by any suitable fastening means, such as screws 40, rivets or other fastening means, to one of the upright peripheral walls of the body 17 of the article-carrying case 16, shown as the side walls 23, and on the inner side thereof (FIGS. 2, 3, 4 and 5).

The supported article or apparatus 32, such as a CB (Citizen's Band) radio apparatus, dictating or recording device, or the like, may include conventional parts therefor such as a microphone, as 41, and a speaker or mike cord unit, as 42, suitably connected to the apparatus 32, and a plug-in power connector 43 and attached electrical power cord unit 44, for electrically connecting the apparatus 32 to an electric outlet, such as a cigarette lighter outlet on the instrument panel of an automotive vehicle, or the like, and an antenna cord 49 which may be attached to an antenna which may be detachably connected to the back of the CB radio unit which may be powered by a DC/AC power supply. Thus the antenna may be detached from the CB radio unit and carried in the article-carrying case 16. The CB radio unit may be powered by a cigarette lighter in the instrument panel of an automotive vehicle, boat, or the like, when used in such an automotive vehicle, boat, or the like, or it may be powered by a DC/AC power supply converter when the CB radio is used as a base station in an office, or like place, using an AC current supply source. Suitable supports, as 45, may be provided on the bottom wall 19 of the body 17 of the article-carrying case 16 for supporting the article or apparatus 32 when it is disposed within the body 17 of the article-carrying case 16 (FIGS. 2 and 3).

Figure 9:
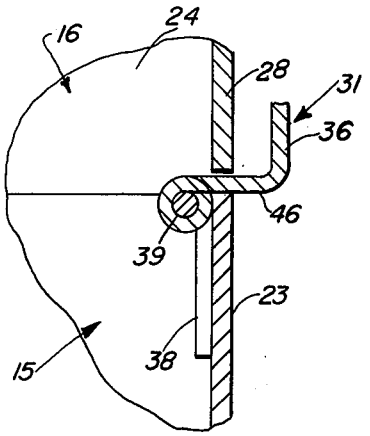
FIG. 9 is an enlarged detail view of the area encircled in FIG. 6.
Figure 10:
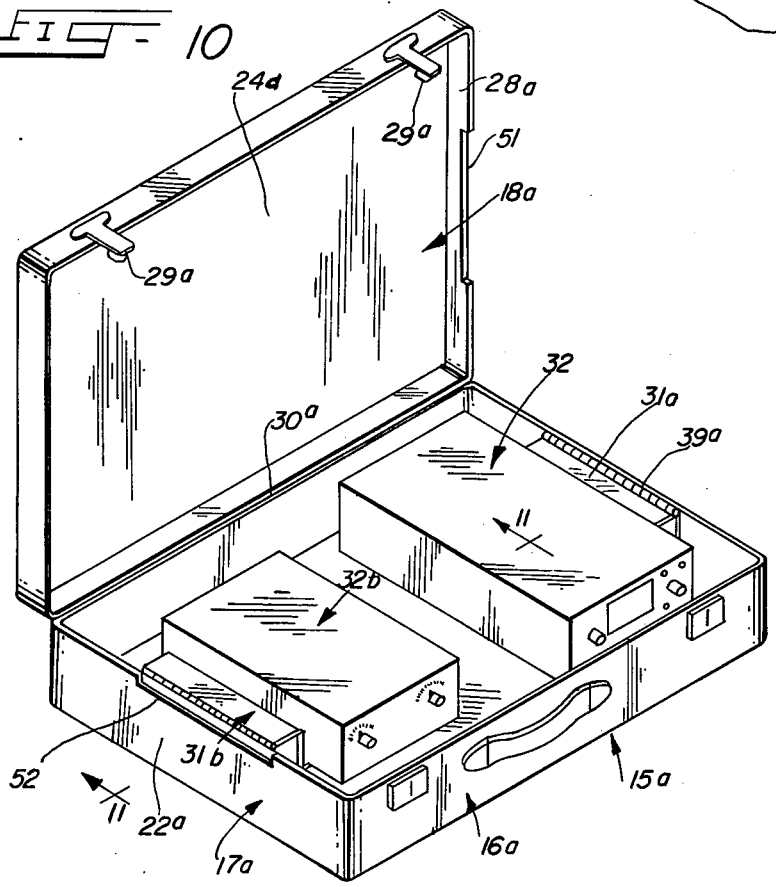
FIG. 10 is a view similar to FIG. 2 but showing a modification of the invention.
Figure 11:
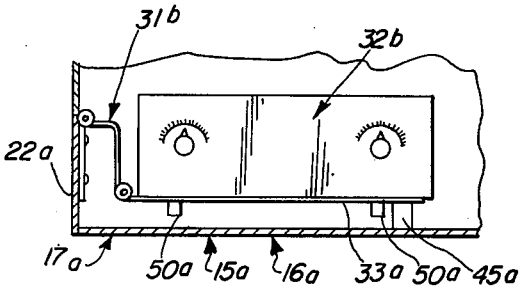
FIG. 11 is a view on line 11—11 in FIG. 10.

It will be noted (FIG. 9) that there is sufficient clearance between the side wall 23 of the body 17 of the article-carrying case 16 and the side wall 28 of the cover 18 to enable the cover 18 to be closed over the then outwardly extending lower arm 46 of the L-shaped intermediate hinge section 36 (FIGS. 6 and 9). This may be accomplished by notching the side wall 23 of the body 17 of the article-carrying case 16, as at 53, or otherwise, as described hereinafter (FIGS. 10 and 11).

OPERATION AND USE OF THE FORM OF THE INVENTION ILLUSTRATED IN FIGS. 1 TO 9, INCLUSIVE, OF THE DRAWINGS

In the use of the form of the invention illustrated in FIGS. 1 to 9, inclusive, the attaching hinge section 38 may be attached, as at 40, to the inner surface of one of the upright peripheral walls, as 23, of the body 17 of the article-carrying case 16, other than the rear wall 21 of the body 17 to which the closure member or cover 18 is hingedly connected, as at 30, and the article or apparatus 32 to be carried, such as a CB (Citizen's Band) radio unit, dictating or recording unit, or the like, may be attached to the article-supporting hinge section and supporting base plate 33 of the hinge unit 31 by suitable fastening elements, such as 35, inserted through the mounting slots 34 in the supporting base plate 33 into the body or housing of the apparatus 32, thereby rigidly and permanently attaching the apparatus 32 to the body 17 of the article-carrying case 16.

When the parts are thus arranged the apparatus 32 may be positioned within the body 17 of the article-carrying case 16, as in FIGS. 2 and 3, and the closure member or top 18 closed and latched, as at 29, to the body 17 of the article-carrying case 16 so that the article or apparatus 32 is thus portable and may be readily carried from place to place as from the user's home or office to an automotive vehicle, boat, or the like.

Figure 4:
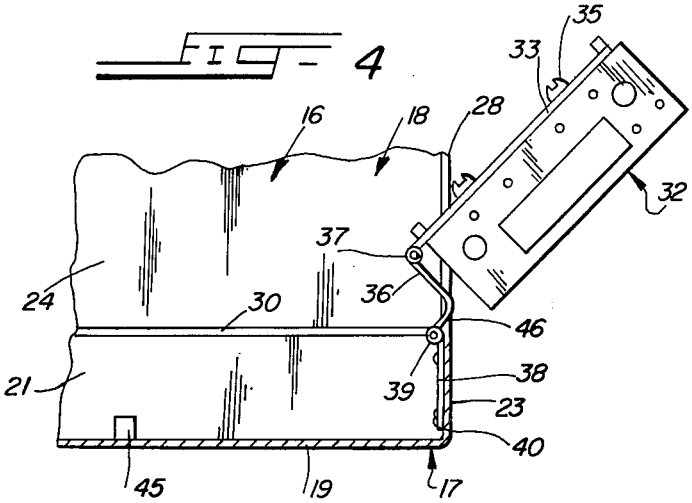
FIG. 4 is a fragmentary view, partly in section and partly in elevation, showing the cover of the article-carrying case shown in FIGS. 1 to 3, inclusive, in open position and showing the hinge unit and the article or apparatus attached thereto partially outfolded from the body of the article-carrying case.
Figure 5:
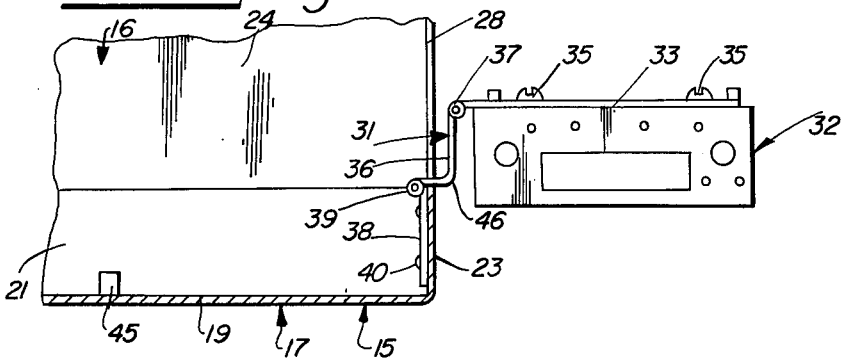
FIG. 5 is a fragmentary elevational view of the embodiment of the invention illustrated in FIGS. 1 to 4, inclusive, and showing the cover of the article-carrying case in open position and showing the article-supporting and attaching hinge unit and the article or apparatus supported thereby outfolded from the body of the article-carrying case.
Figure 7:
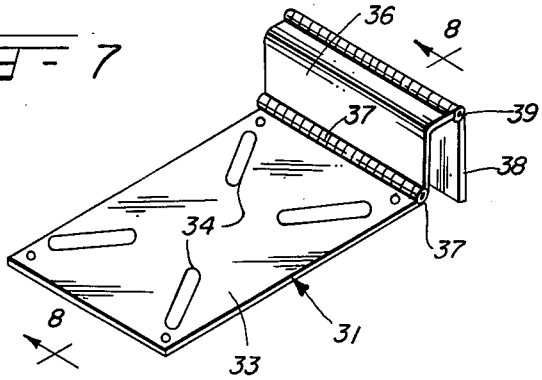
FIG. 7 is a perspective view of the new article-supporting and attaching hinge unit illustrated in FIGS. 1 to 6, inclusive.
Figure 8:
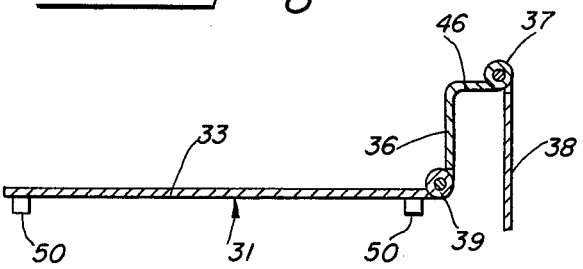
FIG. 8 is a longitudinal sectional view on line 8—8 in FIG. 7.

After the user reaches his destination, such as an automotive vehicle, boat, or the like, where he may wish to use the apparatus 32, such as a CB (Citizen's Band) radio, dictating or recording unit, or the like, he may unlatch the closure member or cover 18 from the body 17 of the article-carrying case 16, at 29, and move the closure member or cover 18, on its hinge connection 30, into open position, as in FIGS. 2 and 3, whereupon he may then hingedly outfold the apparatus 32 from the body 17 of the article-carrying case 16, as in FIGS. 2, and 3, through the position in which it is shown in FIG. 4 into the position in which it is shown in FIG. 5. During this operation, the L-shaped intermediate hinge section 36 pivots on its hinge 38, and the supporting hinge section and base plate 33 and attached article or apparatus 32 pivot on the hinge connection 37 within and relative to the L-shaped intermediate hinge section 36 and the article or apparatus 32 is then disposed in inverted position, as in FIG. 5.

The closure member or cover 18 may then be closed over the body 17 of the article-carrying case 16, whereupon the supporting hinge section and base plate 33, and the article or apparatus 32 mounted thereon may be hingedly pivoted, at 37, into a position with the article or apparatus 32 rested and supported in upright position on the upper surface of the top wall 24 of the closure member or cover unit 18, as shown in FIGS. 1 and 6. During this operation the supporting hinge section and base plate 33 and L-shaped intermediate hinge section 36-46 pivot on the hinged connection 39 relative to the attaching hinge section 38 and the intermediate hinge section 36-46 is then positioned outside the body 17 of the article-carrying case 16, as shown in FIG. 6. When the article or apparatus 32 is thus disposed in position of use, as in FIGS. 1 and 6, it is prevented from sliding or falling off the top wall 24 of the cover 18 on which it rests in position of use.

The electrical plug-in power connector 43 and attached electrical power cord unit 44 may then be attached to a suitable electrical outlet, such as a cigarette lighter outlet in the instrument panel of an automotive vehicle, boat, or the like, and the microphone 41 and attached mike cord 42, and antenna, used in a conventional way.

It will thus be noted that the invention provides a novel article-carrying case and attaching and article-supporting hinge unit therefor for manually carrying a portable unit or apparatus, such as a CB (Citizen's Band) radio dictating or recording device, or the like, from the user's home or office to a place of use, such as an automotive vehicle, boat or the like, in which it may be readily positioned over and supported on the closed top or cover of the body of the article-carrying case without risk of it sliding or falling therefrom while, at the same time, eliminating the risk of theft which exists in many instances in an automotive vehicle, boat, or the like.

It will be noted that in the use of the invention the intermediate hinge section 36–46 is hingedly connected to the attaching hinge section 38 within the body 17 of the article-carrying case 16 for movement through an arc of approximately 180° from the position in which the parts are shown in FIGS. 2 and 3 into the position in which they are shown in FIG. 5, and that the article-supporting hinge section 33 is hingedly connected to the intermediate hinge section 36–46 for movement through an arc of approximately 180° from the position in which the parts are shown in FIG. 5 into the position in which the parts are shown in FIGS. 1 and 6, thereby enabling the article or apparatus 32 mounted on the article-supporting hinge section 23 to be moved from inverted position, as in FIG. 5, into upright position on the top wall 24 of the cover 18, as in FIGS. 1 and 6.

THE MODIFICATION ILLUSTRATED IN FIGS. 10 AND 11

A modification of the invention is illustrated in FIGS. 10 and 11 of the drawings, and those parts thereof which are similar to or correspond to parts in the form of the invention illustrated in FIGS. 1 to 9, inclusive, have been given the same reference numerals followed by the additional and distinguishing reference character "a".

The form of the invention illustrated in FIGS. 10 and 11 differs from the form of the invention illustrated in FIGS. 1 to 9, inclusive, in that in the form of the invention a second article-supporting and attaching hinge unit **31*b* is employed and is attached to the inner surface of another one of the upright peripheral walls, as 22*a*, of the body 17*a* of the article-carrying case 16*a*, and an apparatus 32*b*, such, for example, as a DC to AC electrical converter, or a rechargeable battery unit, may be mounted on the supporting base plate 33*a* thereof to be housed within the body 17*a* of the article-carrying case 16*a* or withdrawn therefrom for use, as described hereinbefore in connection with the form of the invention illustrated in FIGS. 1 to 9, inclusive, and to enable a radio, as 32**, to be used anywhere at any time.

In the form of the invention illustrated in FIGS. 10 and 11, the side wall **22*a* of the body 17*a* of the article-carrying case 16*a* may be notched, as at 52, or the side wall 28*a* of the cover 18*a* may be notched, as at 51, to enable the cover 18*a* to be closed over the hinge units 31*a* and 31*b***.

THE MODIFICATION ILLUSTRATED IN FIG. 12

Figure 12:
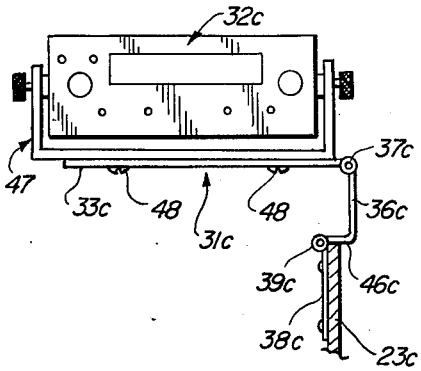
FIG. 12 is an elevational view, partly in section, of another modification of the invention.

Another modification of the invention is illustrated in FIG. 12 of the drawings and those parts thereof which are similar or correspond to parts in the form of the invention illustrated in FIGS. 1 to 9, inclusive, have been given the same reference numerals followed by the additional and distinguishing reference character "c".

The form of the invention illustrated in FIG. 12 is substantially similar to that illustrated in FIGS. 1 to 9, inclusive, except that in this form of the invention the article or apparatus **32*c*, such as a radio unit, or the like, is attached to a generally U-shaped bracket 47 which, in turn, is attached by suitable fastening elements 48 to the article-supporting hinge section 31*c***.

THE MODIFICATION ILLUSTRATED IN FIGS. 13, 14 AND 15

Another modification of the invention is illustrated in FIGS. 13 to 15, inclusive, of the drawings, and those parts thereof which correspond to similar parts in the form of the invention illustrated in FIGS. 1 to 9, inclusive, have been given similar reference numerals followed by the additional and distinguishing reference character "d".

The form of the invention illustrated in FIGS. 13 to 15, inclusive, differs from the form of the invention illustrated in FIGS. 1 to 9, inclusive, in that in this form of the invention an auxiliary flange member 53 is formed integrally with the supporting base plate **33*d* of the attaching and article-supporting hinge unit 31*d* and extends rightangularly therefrom at one end thereof and extends between the supporting base plate 33*d* and the hinge unit 31*d* which, in this form of construction, hingedly connects the flange member 33*d* and the hinge section 36*d***.

The construction illustrated in FIGS. 13, 14 and 15 enables an article or apparatus **32*d* of relatively larger height, than the article or apparatus 32 illustrated in FIGS. 1 to 9, inclusive, to be carried in the article-carrying case 16*d* which has a body 17*d* which is relatively deeper than the body 17, while, at the same time, the form of construction illustrated in FIGS. 13 to 15, inclusive, uses a relatively smaller or shallower cover or closure member 18*d*. This form of construction likewise enables the supporting base plate 33*d* to rest on the top wall 24*d* of the closure member or top cover 18*d*, when in position of use, or on the bottom wall 19*d* of the body 17*d* of the article-carrying case 16*d*** when not in use.

THE MODIFICATION ILLUSTRATED IN FIG. 16

Another modification of the invention is illustrated in FIG. 16 of the drawings, and those parts thereof which are similar to or correspond to parts in the form of the invention illustrated in FIGS. 1 to 9, inclusive, have been given similar reference numerals followed by the additional and distinguishing reference character "e".

The form of the invention illustrated in FIG. 16 differs from the form of the invention illustrated in FIGS. 1 to 9, inclusive, in that in this form of the invention the attaching and article-supporting hinge unit **31*e* includes a main body portion and an auxiliary attaching flange member 54 which is formed integrally with and extends rightangularly from the hinge section 38 at one end thereof and is adapted to be attached to a supporting member. This form of construction enables the attaching and article-supporting hinge unit 31*e* to be used without attaching it to a side wall, as 23, of the body of the article-carrying case 16 and enables it to be attached to the bottom wall of the body of the article-carrying case by attaching the auxiliary flange member 54, in any suitable manner, and by any suitable fastening means, to a supporting member, such as at the bottom wall of the body of the article-carrying case 16*e*** which may be desirable in those instances in which the side walls of the body of the article-carrying case may not be sufficiently strong to support the weight of the article or apparatus mounted on the attaching and article-supporting hinge unit.

It will thus be seen from the foregoing description, considered in conjunction with the accompanying drawings, that the present invention provides a new and improved article-carrying case and article-supporting and attaching hinge unit therefor, having the desirable advantages and characteristics and accomplishing its intended objects, including those hereinbefore pointed out, and others which are inherent in the invention.

I claim:

1. A hinge unit for attachment to a container which includes a body having side walls and a bottom wall and having a cover hingedly connected thereto and including a top wall, said hinge unit comprising:

(a) an attaching hinge section including means to rigidly attach to one of the walls of the said container;

(b) an article-supporting hinge section including means to attach mounted thereon and to be arranged with the said article or apparatus within the interior of the said container and including means to be arranged with the said article or apparatus on the top wall of the said cover;

(c) an intermediate hinge section between the said attaching hinge section and the said article-supporting hinge section including (1) a body having (2) opposite end portions;

(d) first hinge means hingedly connecting one of the said end portions of the said intermediate hinge section to the said attaching hinge section for movement of the said intermediate hinge section in a vertical plane relative to the said attaching hinge section and toward and away from the said container; and (e) second hinge means hingedly connecting the other end portion of the said intermediate hinge section for movement with the said article or apparatus supported thereon and with the said intermediate hinge section toward and away from the said container.

2. A hinge unit as defined in claim 1 in which (a) the said intermediate hinge section is movable on the said first hinge means relative to the said attaching hinge section through an arc of approximately 180° in a vertical plane toward and away from the said container; and in which (b) the said article-supporting hinge section and an article supported thereby are movable on the said second hinge means through an arc of approximately 180° in a vertical plane toward and away from the said container.

3. A hinge unit as defined in claim 1 in which (a) the said intermediate hinge section is generally L-shaped in form; and in which (b) the said one end portion of the said intermediate hinge section extends generally rightangularly from the said body of the said intermediate hinge section.

4. A hinge unit as defined in claim 1 in which the said article-supporting hinge section includes (a) a flange member integrally attached to and extending generally rightangularly from the said article-supporting hinge section at one end thereof and hingedly connected to and between the said article-supporting hinge section and the said attaching hinge section.

5. A hinge unit as defined in claim 1 in which the said attaching hinge section includes (a) a main body portion; and (b) an auxiliary attaching flange member extending generally rightangularly from the said main body portion and adapted to be attached to the said container.

6. A hinge unit for attachment to an article-carrying case which includes a body having a bottom wall and side walls and a cover hingedly connected to one of the said side walls of the said body for movement into and out of closed position relative to the said body, including a top wall, said hinge unit comprising:

(a) an attaching hinge section adapted to be rigidly attached to one of the said walls of the said body on the inner surface thereof;

(b) an article-supporting hinge section adapted to have an article or apparatus attached thereto and to be arranged with the said article or apparatus within the interior of the body of the said article-carrying case and adapted to be arranged with the said article or apparatus attached thereto on the top wall of the said cover;

(c) the said article-supporting hinge section mounted thereon for movement with the said article-supporting hinge section in a verticle plane into and out of the interior of the said body of the said article-carrying case and onto and off from the top wall of the said cover;

(d) an intermediate hinge section between the said attaching hinge section and the said article-supporting hinge section including
(1) a body having
(2) opposite end portions;

(e) first hinge means hingedly connecting one of the said end portions of the said intermediate hinge section to the said attaching hinge section for movement of the said intermediate hinge section with the said article-supporting hinge section and an article or apparatus mounted thereon in a vertical plane relative to the said attaching hinge section and into and out of the said body of the said article-carrying case; and (f) second hinge means hingedly connecting the other end portion of the said intermediate hinge section to the said article-supporting hinge section for movement with the said article or apparatus into and out of the said body of the said article-carrying case.

7. A hinge unit as defined in claim 6 in which (a) the said intermediate hinge section is movable on the said first hinge means relative to the said attaching hinge section through an arc of approximately 180° in a vertical plane into and out of the said body of the said article-carrying case; and in which (b) the said article-supporting hinge section is movable on the said second hinge means relative to the said intermediate hinge section through an arc of approximately 180° in a vertical plane into and out of the said body of the said article-carrying case.

8. A hinge unit as defined in claim 6 in which (a) the said intermediate hinge section is generally L-shaped in form; and in which (b) the said one end portion of the said intermediate hinge section extends generally rightangularly from the said body of the said intermediate hinge section.

9. A hinge unit as defined in claim 6 in which the said article-supporting hinge section includes (a) a flange member integrally attached to and extending generally rightangularly from the said article-supporting hinge section at one end thereof and hingedly connected to and between the said article-supporting hinge section and the said attaching hinge section.

10. A hinge unit as defined in claim 6 in which (a) the said one of the said walls of the said body is the said bottom wall thereof; and in which (b) the said attaching hinge section includes a portion adapted to be attached to the said bottom wall of the said body on the inner surface thereof.

11. An article-carrying case and attaching and article supporting hinge unit therefor, comprising (a) an article-carrying case comprising a body having
(1) a bottom wall; and
(2) a plurality of upright peripheral walls extending upwardly from the said bottom wall around the peripheral thereof;

(b) a closure member or cover hingedly connected to a first one of the said upright peripheral walls and including
(1) a top wall;

(c) a combination article-supporting and hinge unit including
(1) first attaching means for attaching the said first combination article-supporting and hinge unit to one of the said walls of the said body of the said article-carrying case;
(2) second hinge means providing an article-supporting base adapted to have an article or apparatus attached thereto and mounted thereon for movement with the said second hinge means; and
(3) third and intermediate hinge means between and hingedly connected to the said first and attaching hinge means and to the said second hinge means;
(4) the said second and article-supporting hinge means and an article or apparatus mounted thereon being positioned within the body of the said article-carrying case for carrying, when not in use, or hingedly positioned outwardly of the said body and positioned on the said top wall of the said cover in position of use.

12. An article-carrying case and attaching and article-supporting hinge unit therefor as defined in claim 11 in which (a) the said one of the said walls of the said body of the said article-carrying case is one of the said side walls of the said body; and in which (b) the said first and attaching means is attached to the said side wall on the inner surface thereof.

13. An article-carrying case and attaching and supporting hinge unit therefor as defined in claim 12 in which (a) the said third and intermediate hinge means is disposed outwardly of the said body of the said article-carrying case when the said closure member or cover is in closed position and the said article or apparatus is disposed over and rested in position of use on the said top of the said cover.

14. An article-supporting case and attaching and article-supporting hinge unit therefor as defined in claim 11 in which (a) the said article-supporting base includes
(1) an auxiliary flange member formed integrally with the said article-supporting base and extending rightangularly therefrom at one end thereof and hingedly connected between the said second hinge means and article-supporting base and the said third and intermediate hinge means.

15. An article-carrying case and attaching and article-supporting hinge unit therefor as defined in claim 11 in which (a) the said first attaching means includes (1) an attaching member adapted to be attached to the said bottom wall of the said body of the said article-carrying case.

16. An article-carrying case and an article-supporting and attached hinge unit therefor comprising:

(a) an article-carrying case including (1) a body having a. a bottom wall;

b. upright peripheral walls extending around and upwardly from the said bottom wall;

(b) a closure member or cover for the said body including (1) a generally flat top wall;

(c) means hingedly connecting the said closure member or cover to a first one of the said upright peripheral walls of the said body;

(d) an article-supporting and attaching hinge unit for supporting an article or apparatus in closed position within the body of the said article-carrying case and attached thereto over the said bottom wall of the said body with the said closure member or cover in closed position over the said article or apparatus to enable it to be manually carried in the said article-carrying case;

(e) the said article-supporting and attaching hinge unit including (1) attaching means for attaching the said article-supporting and attaching hinge unit to a second one of the said upright peripheral walls of the said body;

(2) article-supporting means for mounting an article or apparatus thereon for movement on the said article-supporting and attaching hinge unit relative to and into and out of the said body;

(3) intermediate hinge means between and hingedly interconnecting the said attaching means and the said article-supporting means;

(f) the said article-supporting means and an article or apparatus mounted thereon being selectively hingedly pivoted on the said intermediate hinge means into a position within the said body over the said bottom wall thereof and the said closure member or top closed thereover to enable the said article or apparatus to be carried in the said article-carrying case, and the said closure member or cover being moved into open position and the said article-supporting means and an article or apparatus mounted thereon hingedly pivoted in a vertical arc on the said intermediate hinge means over the said second one of the said upright peripheral walls outwardly of the said body and the said closure member or top then closed over the said body and the said article-supporting means and an article or apparatus thereon hingedly pivoted in a vertical arc into a position over and generally parallel to and rested upon the said generally flat top wall of the said closure member or cover in position of use.

17. An article-carrying case and an article-supporting and attaching hinge unit therefor as defined in claim 16 in which (a) the said upright peripheral walls include (1) generally parallel front and rear walls; and (2) generally parallel side walls, and in which (b) the said first one of the said upright peripheral walls is the rear wall of the said body, and in which (c) the said second one of the said upright peripheral walls of the said body is one of the said side walls thereof.

18. An article-carrying case and an article-supporting and attaching hinge unit therefor as defined in claim 16 in which (a) the said intermediate hinge means includes (1) a hinge member which includes a. a main body portion; and b. an angled end portion which extends generally rightangularly from the said main body portion at one end thereof and is hingedly connected to the said attaching means and in use projects generally rightangularly outwardly of and relative to the said body of the said article-carrying case.

19. An article-carrying case and attaching and article-supporting hinge unit therefor comprising:

(a) an article-carrying case including (1) a bottom wall;

(2) generally parallel side walls;

(3) generally parallel front and rear walls;

(b) a closure member or cover for the said body;

(c) means hingedly connecting the said closure member or cover to the said rear wall of the said body for pivotal hinged movement of the said closure member or cover into closed and open positions;

(d) an attaching and article-supporting hinge unit, including (1) an attaching hinge section rigidly attached to one of the said side walls of the said body within the said body;

(2) an article-supporting hinge section providing an article-supporting base plate adapted to have an article or apparatus attached thereto and mounted thereon;

(3) an intermediate hinge section between the said attaching hinge section and the said article-supporting hinge section;

(4) first hinge means hingedly interconnecting the said attaching hinge section and the said intermediate hinge section;

(5) second hinge means hingedly interconnecting the said intermediate hinge section and the said article-supporting hinge section;

(e) the said article-supporting hinge section and an article or apparatus attached thereto being downfolded and infolded on the said intermediate hinge section into a position within the said body of the said article-carrying case and into a position generally parallel to but above the said bottom wall thereof when the said closure member or cover is in open position, and the said closure member or cover is hingedly lowered into closed position thereover for carrying the said article or apparatus and, when in use, the said closure member or cover being opened and the said article-supporting hinge section being hingedly outfolded on the said intermediate hinge section by movement in a vertical arc over the said one of the said side walls into a position outwardly of and generally rightangularly relative thereto and the said closure member or cover being lowered into closed position and the article-supporting hinge section and attached article or apparatus being infolded and downfolded in a vertical arc over the top of the said closed closure member or cover and rested and supported thereon in position of use.

20. An article-carrying case and attaching and article-supporting hinge unit therefor comprising, in combination:

(a) an article-carrying case including a body having
  (1) a bottom wall; and
  (2) a plurality of upright peripheral walls extending upwardly from the said bottom wall around the periphery thereof;

(b) a closure member or cover for the said body hingedly connected to a first one of the said upright peripheral walls of the said body for pivotal hinged movement of the said closure member or cover into closed and open position;

(c) a combination article-supporting and hinge unit including
  (1) a first and attaching hinge section rigidly attached to a second one of the said upright walls of the said body and within the said body;
  (2) a second and article-supporting hinge section providing a supporting base for attachment to and for supporting an article or apparatus mounted thereon;
  (3) a third and intermediate hinge section between the said first and attaching hinge section and the said second and article-supporting hinge section and including
    a. a first end portion; and
    b. a second end portion;

(d) means hingedly interconnecting the said first end portion of the said third and intermediate hinge section to the said second and article-supporting hinge section for pivotal movement of the said second and article-supporting hinge section in a vertical plane relative to the said first and attaching hinge section and relative to and outwardly of the said second one of the said upright walls of the said body and relative to and over the said closure member or cover when the said closure member or cover is in closed position; and (e) means hingedly interconnecting the said second end portion of the said third and intermediate hinge section to the said first and attaching hinge section within the said body of the said article-carrying case for movement of the said third and intermediate hinge section and the said second and article-supporting hinge section and an article supported thereby in a vertical plane relative to and over the said second one of the said upright walls of the said body and outwardly of the said body when the said closure member or cover is in open position.

21. An article-carrying case and attaching and article-supporting hinge unit therefor, as defined in claim 20, in which (a) the said third and intermediate hinge section is substantially L-shaped in form, and includes
  (1) a main body providing the said first end portion thereof and
  (2) an arm extending generally rightangularly from the said main body and providing the said second end portion thereof.

22. An article-carrying case and attaching and article-supporting hinge unit therefor as defined in claim 20 in which the said upright peripheral walls of the said body include (a) generally parallel front and rear walls; and
(b) generally parallel side walls; and in which
(c) the said first one of the said upright peripheral walls of the said body to which the said closure member or cover is hingedly connected is the said rear wall of the said body; and in which
(d) the said second one of the said upright peripheral walls of the said body to which the said first and attaching hinge section is attached is one of the said side walls of the said body of the said article-carrying case.

23. An article-carrying case and attaching and article-supporting hinge unit therefor as defined in claim 22 in which (a) the said first and attaching hinge section is generally rectangular in form; and in which
(b) the said second and article-supporting hinge section is generally rightangular in form and extends generally rightangularly from and relative to the said first and attaching hinge section and the said third and intermediate hinge section.

* * * * *